US008733867B2

(12) United States Patent
Hwang et al.

(10) Patent No.: US 8,733,867 B2
(45) Date of Patent: May 27, 2014

(54) DRAWER AND REFRIGERATOR INCLUDING THE SAME

(71) Applicants: Jungyeon Hwang, Changwon-si (KR); Seonkyu Kim, Changwon-si (KR); Seungjin Yoon, Changwon-si (KR); Woonkyu Seo, Changwon-si (KR); Daesung Lee, Changwon-si (KR)

(72) Inventors: Jungyeon Hwang, Changwon-si (KR); Seonkyu Kim, Changwon-si (KR); Seungjin Yoon, Changwon-si (KR); Woonkyu Seo, Changwon-si (KR); Daesung Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/659,365

(22) Filed: Oct. 24, 2012

(65) Prior Publication Data

US 2013/0099651 A1 Apr. 25, 2013

(30) Foreign Application Priority Data

Oct. 25, 2011 (KR) ..... 10-2011-0109348

(51) Int. Cl.
*A47B 96/04* (2006.01)

(52) U.S. Cl.
USPC ..... 312/402; 312/404

(58) Field of Classification Search
USPC ..... 312/401, 404, 348.3, 402; 220/501, 220/552, 529, 528, 530, 532, 533, 534, 538, 220/539, 544
See application file for complete search history.

(56) References Cited

U.S. PATENT DOCUMENTS

| | | | | |
|---|---|---|---|---|
| 3,117,688 | A * | 1/1964 | Walstad et al. | 217/7 |
| 5,269,600 | A * | 12/1993 | Arreola et al. | 312/348.3 |
| 5,366,283 | A * | 11/1994 | Crose | 312/183 |
| 7,296,433 | B2 * | 11/2007 | Uihlein et al. | 62/441 |
| 7,874,176 | B2 * | 1/2011 | Uihlein et al. | 62/441 |
| 8,434,837 | B2 * | 5/2013 | Lee et al. | 312/402 |
| 8,590,992 | B2 * | 11/2013 | Lim et al. | 312/404 |
| 2008/0129167 | A1 * | 6/2008 | Rand et al. | 312/330.1 |
| 2010/0319391 | A1 * | 12/2010 | Lim et al. | 62/441 |

* cited by examiner

*Primary Examiner* — Daniel Rohrhoff
(74) *Attorney, Agent, or Firm* — McKenna Long & Aldridge LLP

(57) ABSTRACT

A drawer of a refrigerator includes a basket extractable and retractable through the refrigerator while having a storage space surrounded by four wall surfaces. A first partition is slidably mounted to facing first and third ones of the wall surfaces, to move between facing second and fourth ones of the wall surfaces, a second partition is arranged to cross the first partition and is slidably mounted to the second and fourth wall surfaces, to move between the first and third wall surfaces. A moving guide disposed at an intersection between the first and second partitions, to guide movements of the first and second partitions. The drawer achieves an enhancement in utilization by virtue of the partitions capable of varying a partitioned size of the drawer.

17 Claims, 9 Drawing Sheets

DRAWER AND REFRIGERATOR INCLUDING THE SAME

This application claims the benefit of Korean Patent Application No. 10-2011-0109348, filed on Oct. 25, 2011, which is hereby incorporated by reference as if fully set forth herein.

BACKGROUND

1. Field of the Disclosure

The present disclosure relates to a drawer having partitions allowing the user to divide an inner storage space of a refrigerator into spaces having appropriate sizes, if necessary, and a refrigerator including the same.

2. Discussion of the Related Art

A refrigerator is an appliance for storing various food articles in a refrigerated or frozen state in order to keep the food articles in a fresh state for a prolonged period of time. Such a refrigerator includes a storage compartment to store food, etc. The storage compartment includes a freezing compartment for storing food in a frozen state, and a refrigerating compartment for storing food in a refrigerated state.

Cold air generated by an evaporator is supplied to both the freezing compartment and the refrigerating compartment. Typically, the cold air is directly supplied from the evaporator to the freezing compartment, and a portion of the cold air is supplied to the refrigerating compartment after flowing through a duct formed in the refrigerator, namely, under the condition that the temperature of the cold air has been increased. Doors are installed at respective front sides of the freezing and refrigerating compartments, to allow food articles to be loaded/unloaded in/from the freezing and refrigerating compartments.

Recently-developed refrigerators have a trend of increasing refrigerator size in order to load various kinds of food articles and a large amount of food articles in accordance with various life styles of users. Such a refrigerator is provided, at a lower portion thereof, with a drawer, which is an extractable/retractable storage container, for convenience of loading/unloading.

However, due to the size of the drawer increased to correspond to an enlargement of the refrigerator, there may be a problem in that food articles such as beverages and meats loaded in the drawer are unorganized. On the other hand, when the interior of the drawer is partitioned into smaller spaces, there may be a problem in that it is difficult to load food articles having a large volume. In this case, there is an use inconvenience.

SUMMARY

Accordingly, the present disclosure is directed to a drawer and a refrigerator including the same that substantially obviate one or more problems due to limitations and disadvantages of the related art.

One object is to provide a drawer including partitions capable of varying a partitioned size of the drawer in accordance with the size of a food article to be loaded in the drawer, to achieve easy arrangement of food articles in the drawer.

Additional advantages, objects, and features may be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drawer of a refrigerator includes a basket extractable and retractable through the refrigerator, the basket having a storage space surrounded by four wall surfaces, a first partition slidably mounted to facing first and third ones of the wall surfaces of the basket at opposite ends of the first partition, respectively, such that the first partition is movable between facing second and fourth ones of the wall surfaces of the basket, a second partition arranged to cross the first partition and slidably mounted to the second and fourth wall surfaces of the basket at opposite ends of the second partition, respectively, such that the second partition is movable between the first and third wall surfaces of the basket, and a moving guide disposed at an intersection between the first partition and the second partition, to guide movements of the first and second partitions. The moving guide can include a locking button for locking the first and second partitions, to prevent the first and second partitions from moving.

The moving guide may further include a moving guide body formed with a first through hole, through which the first partition extends, and a second through hole, through which the second partition extends, the second through hole being vertically spaced apart from the first through hole.

The first partition may include a first opening, through which the second partition extends while crossing the first opening.

The locking button may include a hook, which is selectively forcibly fitted between the first partition and the second partition, to lock the first and second partitions.

The locking button may further include a pressing knob disposed at a top of the moving guide body such that the pressing knob pivots about a pivot pin arranged between opposite ends of the pressing knob. The hook may be disposed at one side of a lower end of the pressing knob.

The moving guide body may be formed, at the top thereof, with an inclined surface to allow the pressing knob to pivot.

The hook may be made of a material exhibiting high surface friction.

The hook may be made of a silicone or a rubber material.

The second partition may include a second opening, through which the first partition extends while crossing the second opening.

At least one of the first and second partitions may include a plurality of linear members vertically spaced apart from one another, and partition frames coupled to opposite ends of the linear members, to maintain a spacing distance between adjacent ones of the linear members.

Each of the linear members may be made of a metal material.

At least one of the first and second partitions may be made of a transparent plastic material.

The basket may include guide grooves respectively formed at the wall surfaces, to extend horizontally, and at least one of the first and second partitions is slidably fitted, at respective opposite ends thereof, in corresponding ones of the guide grooves, to move horizontally along the corresponding guide grooves.

The at least one of the first and second partitions may be provided, at respective opposite ends thereof, with rollers to move along the corresponding guide grooves while rotating.

Each of the guide grooves may be formed, at a surface thereof, with a protrusion/groove structure. Each of the rollers may be formed, at a circumferential surface thereof, with teeth engagable with the protrusion/groove structure of the corresponding guide groove.

Each of the guide grooves may have an inlet with a reduced width to prevent the corresponding roller from being separated from the guide groove.

In another aspect, a refrigerator includes a body provided therein with a storage compartment, and a drawer extractable and retractable through the storage compartment, wherein the drawer includes a basket having a storage space surrounded by two pairs of facing wall surfaces, a first partition slidably mounted to facing first and third ones of the wall surfaces of the basket at opposite ends of the first partition, respectively, such that the first partition is movable between facing second and fourth ones of the wall surfaces of the basket, a second partition arranged to cross the first partition and slidably mounted to the second and fourth wall surfaces of the basket at opposite ends of the second partition, respectively, such that the second partition is movable between the first and third wall surfaces of the basket, and a moving guide disposed at an intersection between the first partition and the second partition, to guide movements of the first and second partitions, wherein the moving guide includes a moving guide body formed with a first through hole, through which the first partition extends, and a second through hole, through which the second partition extends, the second through hole being vertically spaced apart from the first through hole. A locking button can be provided at a top of the moving guide body, to selectively lock the first and second partitions, to prevent the first and second partitions from moving.

The locking button may include a hook, which is selectively forcibly fitted between the first partition and the second partition, to lock the first and second partitions, and a pressing knob disposed at the top of the moving guide body such that the pressing knob pivots about a pivot pin arranged between opposite ends of the pressing knob.

The refrigerator drawer according to embodiments of the present invention achieves an enhancement in utilization in that it is provided with partitions capable of varying a partitioned size of the drawer in accordance with the size of a food article to be loaded in the drawer. The partitions can also be locked to prevent food articles stored in the drawer from moving during extraction and retraction of the drawer. Thus, it is possible to achieve easy arrangement of food articles in the drawer.

It is to be understood that both the foregoing general description and the following detailed description are exemplary and explanatory and should not be construed as limiting the scope of the invention.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principle of the invention. In the drawings.

DETAILED DESCRIPTION OF THE EMBODIMENTS

Reference will now be made in detail to the preferred embodiments of the present invention related to a refrigerator drawer and a refrigerator including the refrigerator drawer, examples of which are illustrated in the accompanying drawings. Wherever possible, the same reference numbers may be used throughout the drawings to refer to the same or like parts, and a repeated description thereof may be omitted.

Figure 1:
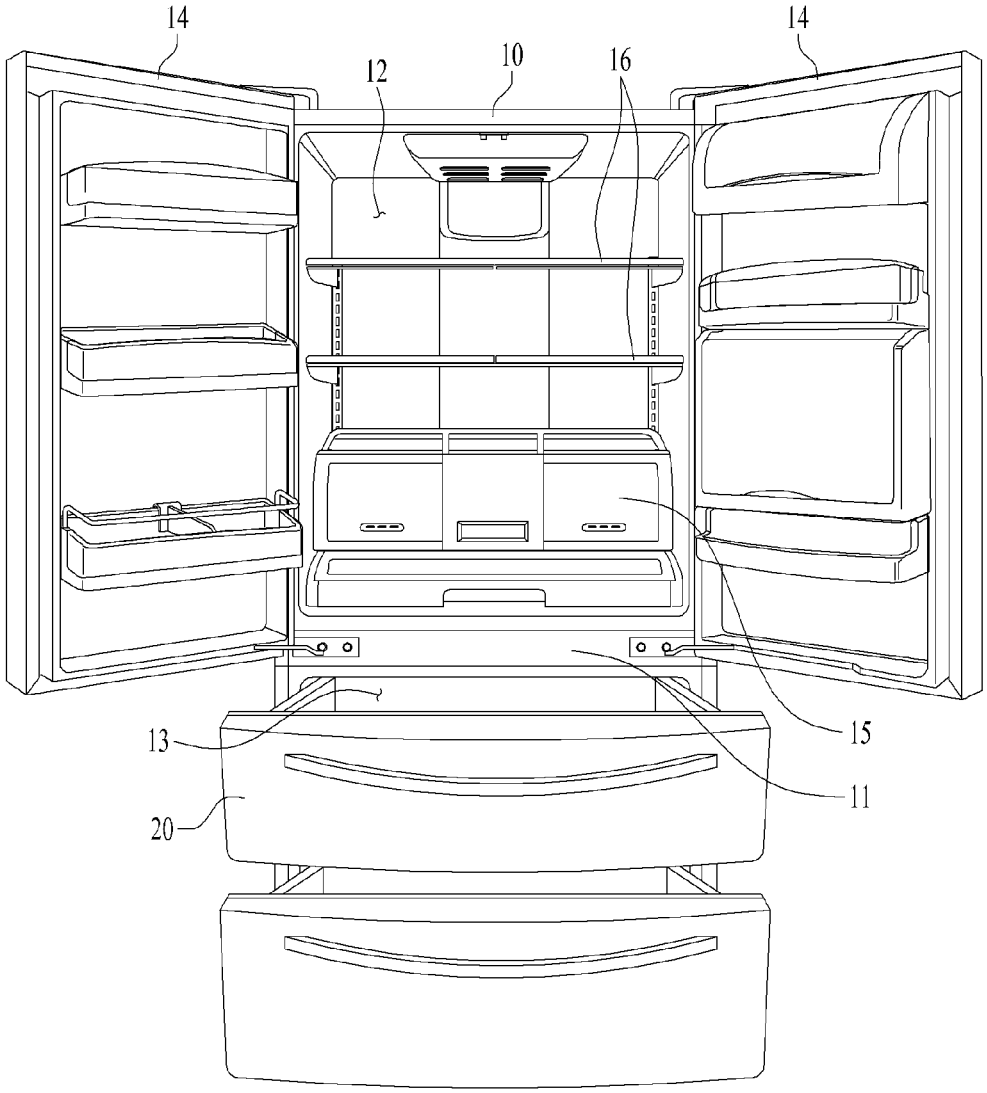
FIG. 1 is a front view of a refrigerator including a drawer according to an embodiment of the present invention.

FIG. 1 is a front view of a refrigerator including a drawer 20 according to an exemplary embodiment of the present invention.

In accordance with the illustrated embodiment of the present invention, the refrigerator includes a body 10 defining an appearance of the refrigerator, and a barrier 11 for partitioning a food storage space defined in the body 10 into an upper compartment, namely, a refrigerating compartment 12, and a lower compartment, namely, a freezing compartment 13. The refrigerator also includes refrigerating compartment doors 14 respectively provided at opposite lateral ends of a front side of the body 10, to selectively open/close the refrigerating compartment 12 in accordance with pivotal movements thereof, and a drawer 20 installed to be extractable and retractable through a front side of the freezing compartment 13.

A plurality of racks 16 is provided at the refrigerating compartment 12, to store food articles under the condition that the food articles are laid on the racks 16. A plurality of storage boxes 15 is provided at the refrigerating compartment 12 beneath the racks 16, to store beverages, etc.

In accordance with the above-described structures, it is possible to store different kinds of food articles that are separated in accordance with different desired storage temperatures.

Figure 2:
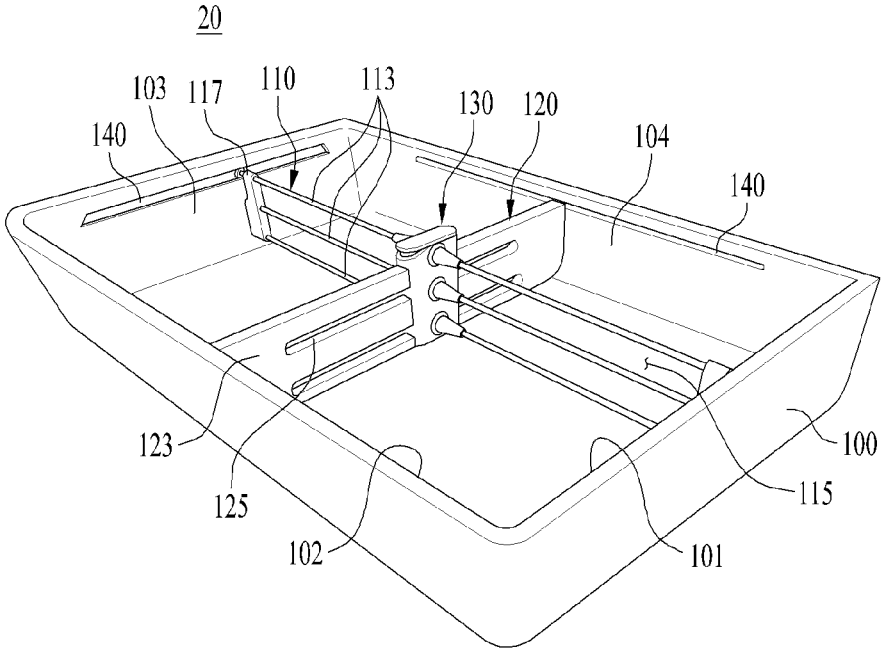
FIG. 2 is a perspective view illustrating the drawer, which has a configuration according to an embodiment of the present invention.

FIG. 2 is a perspective view illustrating the drawer 20, which has a configuration according to an embodiment of the present invention. As shown in FIG. 2, the drawer 20 includes a basket 100 provided with a storage space, first and second partitions 110 and 120 for partitioning the storage space of the basket 100, and a moving guide 130 disposed at an intersection between the first and second partitions 110 and 120, to guide movements of the first and second partitions 110 and 120 and to hold the first and second partitions 110 and 120 at desired positions.

The basket 100, which is provided with a storage space to store food therein, is extractable and retractable through the refrigerator in accordance with pulling and pushing operations. The storage space is defined by two pairs of facing wall surfaces 101, 102, 103, and 104. The first wall surface 101 and third wall surface 103 face each other, and the second wall surface 102 and fourth wall surface 104 face each other.

The basket 100 is a box-shaped member provided with a storage space surrounded by four wall surfaces, namely, the wall surfaces 101, 102, 103, and 104. Generally, the basket 100 may be disposed at a lower portion of the refrigerator body 10. The basket 100 is used to store food, irrespective of the refrigerating compartment or the freezing compartment. The basket 100 has an increased size in accordance with the recent trend of increasing refrigerator size.

Although such a basket has an advantage in that it is possible to store a food article even having a large volume by virtue of an increased inner space, there is a problem in that it is difficult to arrange food articles in the basket when food articles having a small volume are stored, in particular, when only a portion of the inner space of the basket is used to store such food articles, because the food articles may move during extraction and retraction of the drawer 20.

The partitions 110 and 120 are wall members to partition the interior of the basket 100 in order to solve the above-described problem. The partitions 110 and 120 function to laterally and longitudinally partition the basket 100. The partitions 110 and 120 include a first partition 110 and a second partition 120. When the partitions 110 and 120 are fixed in place in the basket 100, it may be impossible to store a food article having a large volume. To this end, the first partition 110 and second partition 120 are linearly movable in directions perpendicular to each other, respectively, to adjust the sizes of the partitioned spaces.

The first partition 110 is slidably mounted, at opposite ends thereof, to the facing first and third surfaces 101 and 103 of the basket 100, respectively, such that it is movable between the second and fourth surfaces 102 and 104 of the basket 100. The second partition 120 crosses the first partition 110, and is slidably mounted, at opposite ends thereof, to the second and fourth surfaces 102 and 104 of the basket 100, respectively, such that it is movable between the first and third surfaces 101 and 103 of the basket 100.

That is, the first partition 110 and second partition 120 partition the storage space of the basket 100 into four spaces while crossing each other. The sizes of the fourth spaces are varied in accordance with movement of the first partition 110 between the second and fourth surfaces 102 and 104 of the basket 100 and movement of the second partition 120 between the first and third surfaces 101 and 103 of the basket 100.

In order to allow the first and second partitions 110 and 120 to move in directions perpendicular to each other, respectively, the first and second partitions 110 and 120 include openings 115 and 125 extending in longitudinal directions of the first and second partitions 110 and 120, respectively. The openings 115 and 125 include a first opening 115 formed through the first partition 110, and a second opening 125 formed through the second partition 120.

Even when only the first opening 115 is formed, and the second opening 125 is not formed, it is possible to linearly move the second partition 120 in a direction perpendicular to the movement direction of the first partition 110 by slidably fitting the second partition 120 through the first opening 115. In this case, however, food articles stored in the spaces partitioned by the first partition 110 may be moved from one space to the other space because the height of the first opening 115 is greater than the height of the second partition 120.

To this end, in order to reduce the vertical size of the opening 115, the second opening 125 is preferably formed at the second partition 120 such that the first partition 110 and second partition 120 cross each other through the first opening 115 and second opening 125, as shown in FIG. 2.

Each of the partitions 110 and 120 may include a plastic member 123 made of a transparent material. The plastic member 123 is lightweight and has certain rigidity. When the plastic member 123 is made of a transparent material, it forms a wall defining partitioned spaces, and allows the user to visually identify food articles stored in the partitioned spaces. Accordingly, an enhancement in the use convenience of the drawer is achieved.

On the other hand, each of the partitions 110 and 120 may include a plurality of linear members 113. Referring to FIG. 2, the first partition 110 is shown as including a plurality of linear members 113. The linear members 113 allow the user to visually identify food articles stored in the spaces partitioned by the linear members 113, as in the plastic member 123, because there are exposed spaces among the linear members 113.

In order to maintain the linear members 113 in a state of being spaced apart from one another by a desired distance, partitions frames 117 are fixedly mounted to opposite ends of the linear members 113, respectively. Preferably, the linear members 113 are made of a metal material having high strength in order to enable the linear members 113 to function as a wall capable of supporting stored food articles.

Although, in FIG. 2, the second partition 120 is shown as including the plastic member 123, which is made of a transparent material, and the first partition 110 is shown as including the linear members 113, each of the first and second partitions 110 and 120 may include the plastic member or the linear members.

The moving guide 130 is positioned at the intersection between the first partition 110 and the second partition 120, to guide movements of the first partition 110 and second partition 120. Preferably, the moving guide 130 includes a locking button 135 for locking the first partition 110 and second partition 120 such that the first partition 110 and second partition 120 cannot move.

When force is applied to the first partition 110 and second partition 120 at the intersection in a desired movement direction, the first partition 110 and second partition 120 are simultaneously moved. Accordingly, when the user moves the moving guide 130 disposed at the intersection between the first partition 110 and the second partition 120 while grasping the moving guide 130, the first partition 110 and second partition 120 are simultaneously moved.

In particular, in accordance with the embodiment of the present invention, the moving guide 130 not only functions to achieve easy movements of the first partition 110 and second partition 120, but also functions to hold the first partition 110 and second partition 120 in a fixed state after the first partition 110 and second partition 120 have partitioned the interior of the basket 100 into spaces having appropriate sizes. When the first partition 110 and second partition 120 are fixed to the moving guide 130 at the intersection, the moving guide 130 cannot move laterally and longitudinally.

When it is desired to maintain spaces partitioned to have appropriate sizes through movements of the first partition 110 and second partition 120, the locking button 135 is pressed to lock the first partition 110 and second partition 120.

Figure 3:
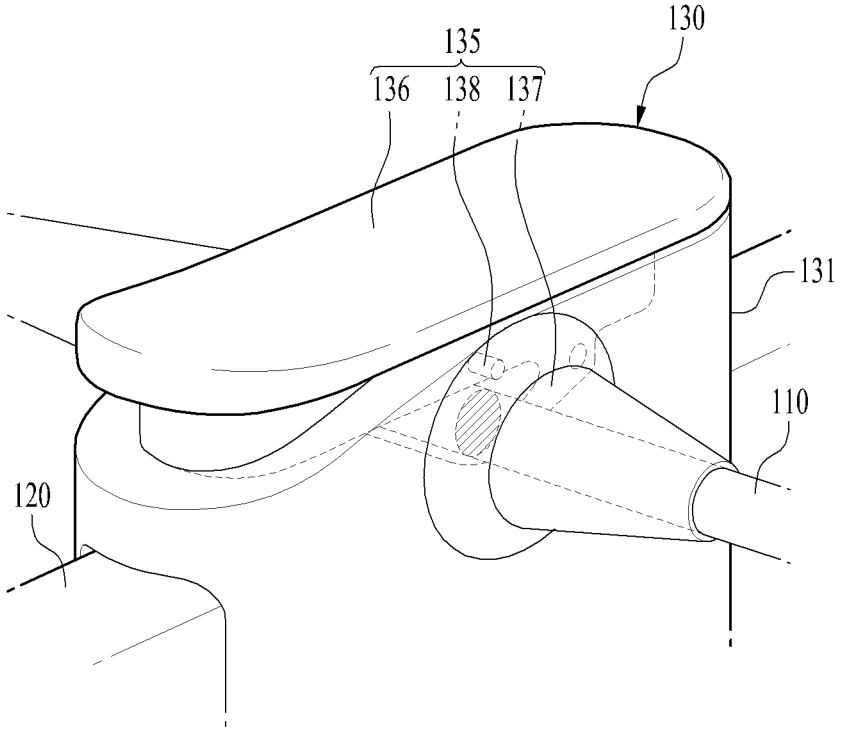
FIG. 3 is a perspective view illustrating a moving guide provided at the drawer according to an embodiment of the present invention.

FIG. 3 is a perspective view illustrating the moving guide 130 provided at the drawer 20 according to an embodiment of the present invention. FIGS. 4 to 7 illustrate the moving guide 130 through a side view, a front view and a sectional view, respectively. Although the moving guide 130 is shown in FIG. 2, a more concrete structure of the moving guide 130 is illustrated in FIGS. 3 to 7 and, as such, it will be described with reference to FIGS. 3 to 7.

Referring to FIG. 3, the moving guide 130 includes a moving guide body 131, through which the first partition 110 and second partition 120 extend while crossing each other. The moving guide 130 also includes the locking button 135, which functions to lock the first partition 110 and second partition 120.

In order to allow the moving guide 130 to move freely in lateral and longitudinal directions, the moving guide body 131 is provided with first through holes 132, through which the first partition 110 extends, and second through holes 133, through which the second partition 120 extends. Each second through hole 133 is arranged between adjacent ones of the first through holes 132 while being vertically spaced apart from the adjacent first through holes 132.

Figure 4:
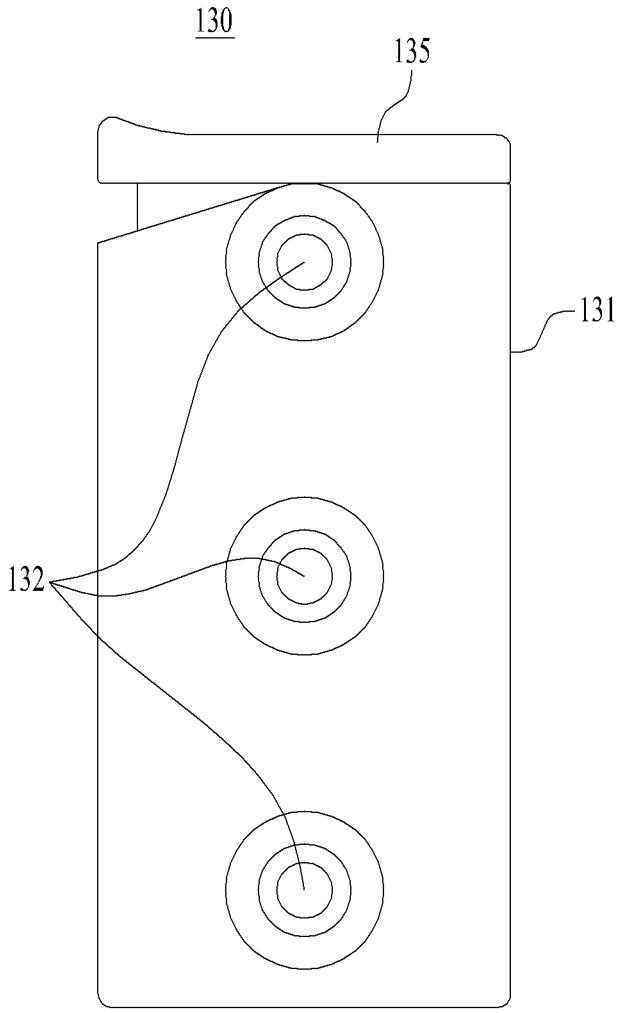
FIG. 4 is a side view of the moving guide corresponding to FIG. 3.
Figure 5:
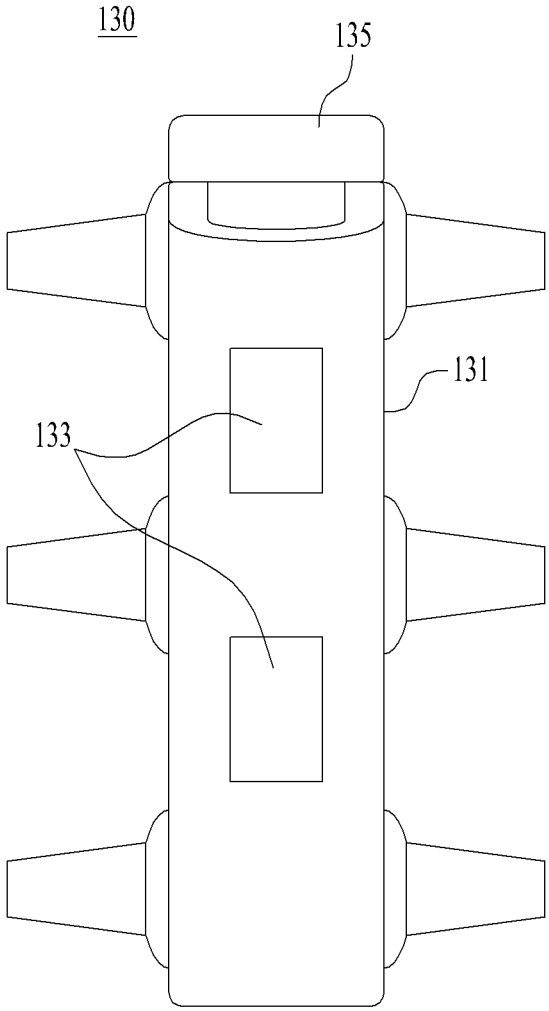
FIG. 5 is a front view of the moving guide corresponding to FIG. 3.

FIG. 4, which is a side view of the moving guide 130, shows the first through holes 132. FIG. 5, which is a front view of the moving guide 130, shows the second through holes, through which the second partition 120 extends.

The first through holes 132 and second through holes 133 are positioned at different levels while extending in crossing directions perpendicular to each other, respectively. Accordingly, the first partition 110 and second partition 120 can move in crossing directions without interfering with each other.

The locking button 135 includes a pressing knob 136, and a hook 137 protruding from one side of a lower end of the pressing knob 136. The pressing knob 136 is disposed at a top of the moving guide body 131. The pressing knob 136 is pivotable about a pivot pin 138 mounted to an intermediate portion of the pressing knob 136 between opposite ends of the pressing knob 136 when the user presses one end of the pressing knob 136. That is, when the user presses an end of the pressing knob 136, the pressing knob 136 pivots about the pivot pin 138 at the intermediate portion of the pressing knob 136, thereby causing the other end of the pressing knob 136 to be upwardly raised. On the other hand, when the other end of the pressing knob 136 is pressed, one end of the pressing knob 136 is upwardly raised.

Figure 6:
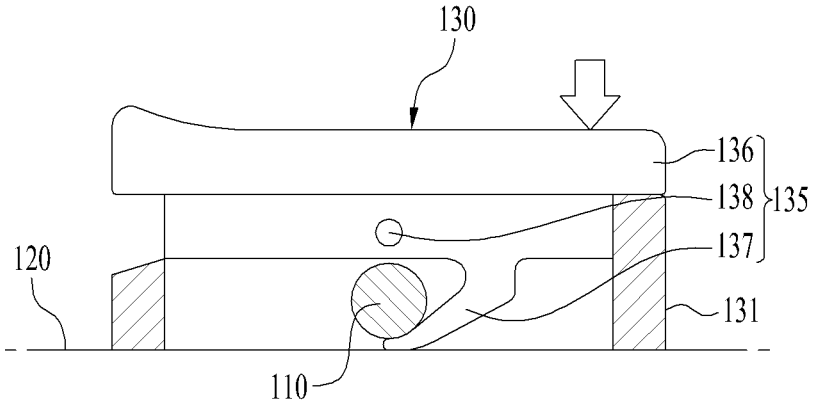
FIGS. 6 and 7 are sectional views of the moving guide corresponding to FIG. 3.
Figure 7:
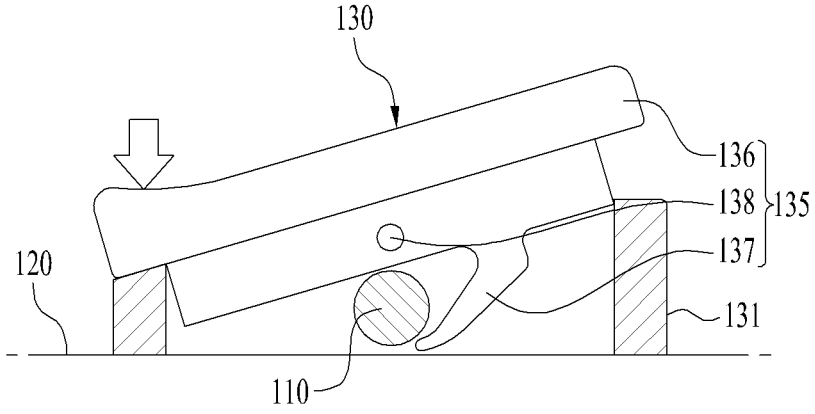

In this case, the pivotal movement range of each end of the locking button 135 is limited by an inclined surface formed at the top of the moving guide body 131, as shown in FIGS. 6 and 7. That is, the pivotal movement range of the locking button 135 corresponds to the inclination angle of the top of the moving guide body 131.

When the pressing knob 136 pivots, the hook 137 mounted to the lower end of the pressing knob 136 may be forcibly fitted between the first partition 110 and the second partition 120. When the hook 137 is fitted between the first partition 110 and the second partition 120, as shown in FIG. 6, the first partition 110 and second partition 120 are fixed and not movable by frictional force.

In order to achieve forcible fitting, the hook 137 may have a tapered shape such that it is thin at a free end thereof and is gradually thickened as it extends away from the free end and toward the lower end of the pressing knob 136. When the pressing knob 136 pivots completely, a portion of the hook 137 having a thickness equal to or slightly greater than a spacing distance between the first partition 110 and the second partition 120 is positioned between the first partition 110 and the second partition 120.

FIG. 6 shows a locked state of the first partition 110 and second partition 120. In this state, one end of the pressing knob 136 has been pressed. Accordingly, the hook 137 is in a state of being forcibly fitted between the first partition 110 and the second partition 120, to prevent movements of the first partition 110 and second partition 120.

The hook 137 may be made of a silicone or a rubber material, taking into consideration the fact that enhanced locking effects are obtained at higher surface friction. In particular, when the hook 137 is made of a rubber material, there is an advantage in that easy forcible fitting can be achieved by virtue of elasticity of the rubber material.

In a state of FIG. 7, the first partition 110 and second partition 120 are freely movable. In this state, the pressing knob 136 of the locking button 135 is under the condition that the other end of the pressing knob 136 has been pressed. On the other hand, the opposite end of the pressing knob 136 has been upwardly raised. Accordingly, the hook 137, which is disposed at one side of the lower end of the pressing knob 136, is spaced apart from the first partition 110 and second partition 120. When the moving guide 130 moves in this state, the first partition 110 and second partition 120 are freely moved because there is no factor interfering with the movements of the first partition 110 and second partition 120.

Figure 8:
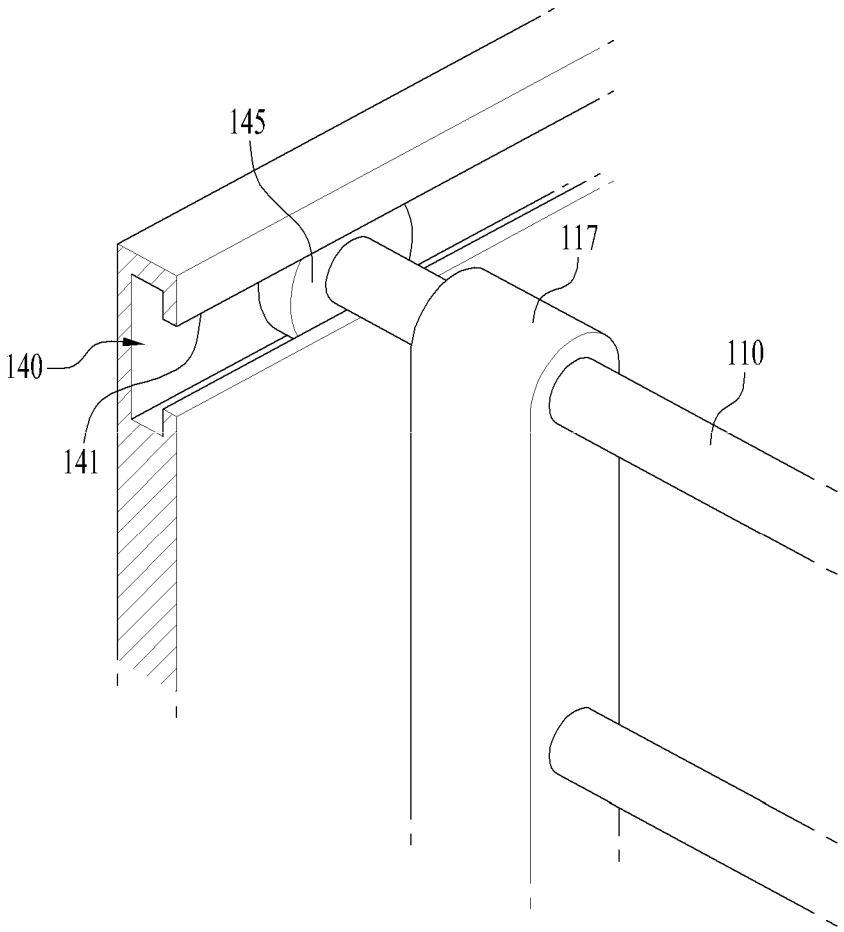
FIGS. 8 and 9 are perspective views illustrating guide grooves and partitions provided at the drawer in accordance with an embodiment of the present invention.
Figure 9:
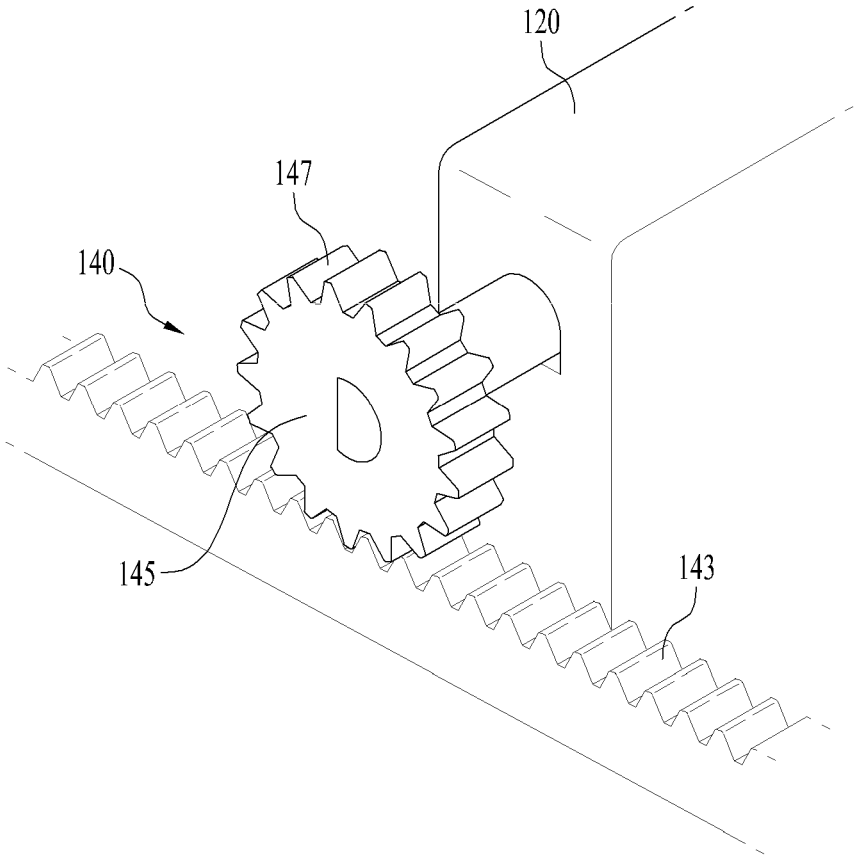

FIGS. 8 and 9 are perspective views illustrating guide grooves 140 provided at the drawer 20 in accordance with an embodiment of the present invention, together with the partitions 110 and 120. Referring to FIG. 8 or 9, a roller 145 is formed at each end of each partition 110 or 120.

Guide grooves 140 are formed at respective wall surfaces of the basket 100 such that they are horizontally elongated.

Respective ends of the first partition 110 and second partition 120 are slidably fitted in the guide grooves 140.

Rollers 145 are provided at respective ends of the first partition 110 and second partition 120 such that they rotate along respective guide grooves 140, to horizontally move the first partition 110 and second partition 120. As shown in FIG. 8, each guide groove 140 preferably has an inlet 141 thereof, which is a smaller size than the roller 145 received in the guide groove 140, to prevent the roller 145 from being separated from the guide groove 140.

Meanwhile, each guide groove 140 may be formed with a protrusion/groove structure 143 at a surface thereof contacting an outer circumferential surface of the roller 145 received therein. When the protrusion/groove structure 143 has a similar size to the roller 145, the roller 145 is seated in one of the grooves of the protrusion/groove structure 143. In this case, accordingly, the roller 145 does not move in a continuous manner, but moves in a stepwise manner at intervals of one groove pitch of the protrusion/groove structure 143. When the protrusion/groove structure 143 has a small size, as shown in FIG. 9, the roller 145 is formed with teeth 147 at the outer circumferential surface thereof. In this case, the roller 145 rotates under the condition that the teeth 147 engage with the protrusion/groove structures 143.

When the protrusion/groove structure 143 is formed at the guide groove 140, it is possible to prevent unintended movement of the roller 145. and thus enhanced locking effects are obtained.

As apparent from the above description, the refrigerator drawer 20 of the present disclosure achieves an enhancement in utilization in that it is provided with partitions capable of varying a partitioned size of the drawer in accordance with the size of a food article to be loaded in the drawer. The partitions can also be locked to prevent food articles stored in the drawer 20 from moving during extraction and retraction of the drawer 20. Thus, it is possible to achieve easy arrangement of food articles in the drawer.

It will be apparent to those skilled in the art that various modifications and variations can be made in the present disclosure without departing from the spirit or scope of the invention. Thus, it is intended that the modifications and variations of this disclosure come within the scope of the appended claims and their equivalents.

What is claimed is:

1. A drawer of a refrigerator comprising:

a basket extractable and retractable through the refrigerator, the basket having a storage space surrounded by four wall surfaces;

a first partition slidably mounted to facing first and third ones of the wall surfaces of the basket at opposite ends of the first partition, respectively, such that the first partition is movable between facing second and fourth ones of the wall surfaces of the basket;

a second partition arranged to cross the first partition and slidably mounted to the second and fourth wall surfaces of the basket at opposite ends of the second partition, respectively, such that the second partition is movable between the first and third wall surfaces of the basket; and a moving guide disposed at an intersection between the first partition and the second partition, to guide movements of the first and second partitions, wherein the moving guide further comprises a locking button to lock the first and second partitions, to prevent the first and second partitions from moving, wherein the locking button comprises a hook, which is selectively forcibly fitted between the first partition and the second partition, to lock the first and second partitions.

2. The drawer according to claim 1, wherein the moving guide further comprises a moving guide body formed with a first through hole, through which the first partition extends, and a second through hole, through which the second partition extends, the second through hole being vertically spaced apart from the first through hole.

3. The drawer according to claim 2, wherein the first partition comprises a first opening, through which the second partition extends while crossing the first opening.

4. The drawer according to claim 3, wherein the second partition comprises a second opening, through which the first partition extends while crossing the second opening.

5. The drawer according to claim 1, wherein:

the locking button further comprises a pressing knob disposed at a top of the moving guide body such that the pressing knob pivots about a pivot pin arranged between opposite ends of the pressing knob; and the hook is disposed at one side of a lower end of the pressing knob.

6. The drawer according to claim 5, wherein the moving guide body is formed, at the top thereof, with an inclined surface to allow the pressing knob to pivot.

7. The drawer according to claim 1, wherein the hook is made of a material exhibiting high surface friction.

8. The drawer according to claim 7, wherein the hook is made of a silicone or a rubber material.

9. The drawer according to claim 1, wherein at least one of the first and second partitions comprises:

a plurality of linear members vertically spaced apart from one another; and partition frames coupled to opposite ends of the linear members, to maintain a spacing distance between adjacent ones of the linear members.

10. The drawer according to claim 9, wherein each of the linear members is made of a metal material.

11. The drawer according to claim 1, wherein at least one of the first and second partitions is made of a transparent plastic material.

12. The drawer according to claim 1, wherein:

the basket comprises guide grooves respectively formed at the wall surfaces, to extend horizontally; and at least one of the first and second partitions is slidably fitted, at respective opposite ends thereof, in corresponding ones of the guide grooves, to move horizontally along the corresponding guide grooves.

13. The drawer according to claim 12, wherein the at least one of the first and second partitions is provided, at respective opposite ends thereof, with rollers to move along the corresponding guide grooves while rotating.

14. The drawer according to claim 13, wherein:

each of the guide grooves is formed, at a surface thereof, with a protrusion/groove structure; and each of the rollers is formed, at a circumferential surface thereof, with teeth engageable with the protrusion/groove structure of the corresponding guide groove.

15. The drawer according to claim 13, wherein each of the guide grooves has an inlet with a reduced width to prevent the corresponding roller from being separated from the guide groove.

16. A refrigerator comprising:

a body provided therein with a storage compartment; and a drawer extractable and retractable through the storage compartment, wherein the drawer comprises:

a basket having a storage space surrounded by two pairs of facing wall surfaces;

a first partition slidably mounted to facing first and third ones of the wall surfaces of the basket at opposite ends of the first partition, respectively, such that the first partition is movable between facing second and fourth ones of the wall surfaces of the basket;

a second partition arranged to cross the first partition and slidably mounted to the second and fourth wall surfaces of the basket at opposite ends of the second partition, respectively, such that the second partition is movable between the first and third wall surfaces of the basket; and a moving guide disposed at an intersection between the first partition and the second partition, to guide movements of the first and second partitions, wherein the moving guide comprises:

a moving guide body formed with a first through hole, through which the first partition extends, a second through hole, through which the second partition extends, the second through hole being vertically spaced apart from the first through hole; and a locking button provided at a top of the moving guide body, to selectively lock the first and second partitions, to prevent the first and second partitions from moving, and wherein the locking button comprises a hook, which is selectively forcibly fitted between the first partition and the second partition, to lock the first and second partitions.

17. The refrigerator according to claim 16, wherein the locking button further comprises:

a pressing knob disposed at the top of the moving guide body such that the pressing knob pivots about a pivot pin arranged between opposite ends of the pressing knob.

* * * * *